US006797377B1

(12) United States Patent
DeLucia et al.

(10) Patent No.: US 6,797,377 B1
(45) Date of Patent: Sep. 28, 2004

(54) CLOTH-LIKE NONWOVEN WEBS MADE FROM THERMOPLASTIC POLYMERS

(75) Inventors: Mary Lucille DeLucia, Roswell, GA (US); Robert L. Hudson, Las Vegas, NV (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/108,054

(22) Filed: Jun. 30, 1998

(51) Int. Cl.[7] ..... D02G 3/00

(52) U.S. Cl. ..... 428/372; 264/218; 428/373; 428/375; 442/327; 442/365; 442/400; 442/401; 523/200; 524/431; 524/447

(58) Field of Search ..... 442/327, 400, 442/401, 361, 365, 237; 264/172.18, 218; 523/200; 524/431, 447; 428/373, 372, 375

(56) References Cited

U.S. PATENT DOCUMENTS

| | | | | | |
|---|---|---|---|---|---|
| 4,254,182 | A | | 3/1981 | Yamaguchi et al. | |
| 4,801,494 | A | | 1/1989 | Datta et al. | 442/352 |
| 5,108,827 | A | * | 4/1992 | Gessner | 428/219 |
| 5,534,335 | A | * | 7/1996 | Everhart et al. | 442/347 |
| 5,632,944 | A | | 5/1997 | Blackwell | |
| 5,681,646 | A | * | 10/1997 | Ofosu et al. | 428/198 |
| 5,686,517 | A | * | 11/1997 | Wells | 524/447 |
| 5,773,119 | A | * | 6/1998 | Wells | 428/85 |
| 5,843,057 | A | * | 12/1998 | McCormack | 604/357 |
| 5,855,999 | A | * | 1/1999 | McCormack | 428/283 |
| 5,869,555 | A | * | 2/1999 | Simmons et al. | 524/229 |

FOREIGN PATENT DOCUMENTS

| | | | |
|---|---|---|---|
| EP | 0683252 | | 11/1995 |
| GB | 2297752 | | 8/1996 |
| GB | 2303375 | | 2/1997 |
| JP | 02-162008 | * | 6/1990 |
| JP | 03-030764 | * | 2/1991 |
| JP | 6184905 | | 5/1994 |
| JP | 06-184905 | * | 7/1994 |
| WO | 9730199 | | 8/1997 |

OTHER PUBLICATIONS

'Microporous Polypropylene Fibers Containing $CaCO_3$ Fillers' by Satoshi Nago and Yukio Mizutani; *Journal of Applied Polymer Science*, vol. 62, pp. 81–86 (1996).

PCT International Search Report Dated Nov. 2, 1999.

* cited by examiner

*Primary Examiner*—Christopher C Pratt
(74) *Attorney, Agent, or Firm*—Dority & Manning, P.A.

(57) ABSTRACT

Extruded fibers and nonwoven webs made from the fibers are disclosed having improved cloth-like properties and an improved aesthetic appearance. The fibers used to form the webs are made from a thermoplastic polymer containing titanium dioxide and at least one mineral filler such as kaolin or calcium carbonate. In particular, the fillers are added in the amount so that the fillers become encapsulated within the polymeric material.

48 Claims, No Drawings

CLOTH-LIKE NONWOVEN WEBS MADE FROM THERMOPLASTIC POLYMERS

FIELD OF THE INVENTION

The present invention is generally directed to cloth-like nonwoven webs. More particularly, the present invention is directed to a process for increasing the softness and decreasing the stiffness of nonwoven webs made from thermoplastic polymers and to a composition which produces softer webs with low luster.

BACKGROUND OF THE INVENTION

Many woven and nonwoven webs and fabrics are formed from thermoplastic polymers, such as polypropylene and polyethylene. For instance, spunbond webs, which are used to make diapers, disposable garments, personal care articles, and the like, are made by spinning a polymeric resin into fibers, such as filaments, and then thermally bonding the fibers together. More particularly, the polymeric resin is typically first heated to at least its softening temperature and then extruded through a spinnerette to form fibers, which can then be subsequently fed through a fiber draw unit. From the fiber draw unit, the fibers are spread onto a foraminous surface where they are formed into a web of material.

Besides spunbond webs, other fabrics made from polymers include meltblown fabrics. Meltblown fabrics are made by extruding a molten polymeric material through a die to form fibers. As the fibers exit the die, a high pressure fluid, such as heated air or steam, attenuates and breaks the fibers into discontinuous fibers of small diameter. The fibers are randomly deposited onto a foraminous surface to form a web.

Spunbond and meltblown fabrics have proven to be very useful for many diverse applications. In particular, the webs are often used to construct liquid absorbent products, such as diapers, feminine hygiene products, and wiper products. The nonwoven webs are also useful in producing disposable garments, various hospital products, such as pads, curtains, and shoe covers and recreational fabrics, such as tent covers. Although well suited for these applications, recently, attention has focused on making the nonwoven webs more cloth-like in order to avoid the plastic-like feel and look of such fabrics. Cloth, as opposed to plastic fabrics, has a more pleasing appearance and feel.

In the past, various attempts have been made to produce more cloth-like fibers from plastic materials in order to produce fibrous webs. For instance, in U.S. Pat. No. 4,254,182 to Yamaguchi, et al., polyester synthetic fibers are disclosed having an irregular uneven random surface formed by microfine recesses and projections to provide more natural feeling fibers. The microfine recesses and projections are produced by incorporating into the fibers silica in a size ranging from 10 to 150 microns and in an amount so as to produce surface projections. It is taught that the surface projections effectively increase the surface area of the fibers and contribute to greater frictional forces, which reduce the slick, waxy feel that is typically associated with plastic resins.

The prior art, however, merely teaches increasing the frictional characteristics of the polymeric fibers in order to remove the wax-like feel of plastics. A need remains for a method that will alter the physical properties of the fibers so that webs made from the fibers will feel more cloth-like and have other cloth-like characteristics. In particular, a need exists for more cloth-like fibrous webs and laminates thereof made from thermoplastic fibers that are less stiff and softer than conventionally made webs.

DEFINITIONS

As used herein the term "nonwoven fabric or web" means a web having a structure of individual fibers or threads which are interlaid, but not in an identifiable manner as in a knitted fabric. Nonwoven fabrics or webs have been formed from many processes, such as for example, melblowing processes, spunbonding processes, and bonded carded web processes. The basis weight of nonwoven fabrics is usually expressed in ounces of material per square yard (osy) or grams per square meter (gsm) and the fiber diameters useful are usually expressed in micros. (Note that to convert from osy to gsm, multiply osy by 33.91).

As used herein the term "spunbond fibers" refers to small diameter fibers which are formed by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel, et al., and U.S. Pat. No. 3,692,618 to Dorschner, et al., U.S. Pat. No. 3,802,817 to Matsuki, et al. U.S. Pat. Nos. 3,338,992 and 3,341,394 to Kinnery, U.S. Pat. No. 3,502,763 to Hartman, U.S. Pat. No. 3,502,538 to Levy, and U.S. Pat. No. 3,542,615 to Dobo, et al. Spunbond fibers are generally not tacky when they are deposited onto a collecting surface. Spunbond fibers are generally continuous and have diameters larger than 7 microns, more particularly, between about 10 and 20 microns.

As used herein the term "meltblown fibers" means fibers formed by extruding a molten thermoplastic material through a plurality of fine, usually circular, die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin. Meltblown fibers are microfibers which may be continuous or discontinuous, are generally smaller than 10 microns in diameter, and are generally tacky and self adherent when deposited onto a collecting surface.

As used herein the term "polymer" generally includes but is not limited to, homopolymers, copolymers, such as for example, block, graft, random and alternating copolymers, terpolymers, etc. and blends and modifications thereof.

As used herein, the term "machine direction" or MD means the length of a fabric in the direction in which it is produced. The term "cross machine direction" or CD means the width of fabric, i.e. a direction generally perpendicular to the MD.

As used herein the term "homopolymer" fiber refers to the fiber or part of a fiber formed from one extruder using only one polymer. This is not meant to exclude fibers formed from one polymer to which small amounts of additives have been added for coloration, anti-static properties, lubrication, hydrophilicity, etc. These additives, e.g. titanium dioxide for coloration, are generally present in an amount less than 5 weight percent and more typically about 2 weight percent. The term "homopolymer" is also not meant to exclude a fiber formed from two or more extruders wherein both of the extruders contain the same polymer.

As used herein the term "bicomponent fibers" refers to fibers which have been formed from at least two polymers extruded from separate extruders but spun together to form one fiber. Bicomponent fibers are also sometimes referred to as multicomponent fibers. The polymers are usually different from each other though bicomponent fibers may be homopolymer fibers. The polymers are arranged in substantially constantly positioned distinct zones across the cross-section of the bicomponent fibers and extended along the length of the bicomponent fibers. The configuration of such a bicomponent fiber may be, for example, a sheath/core arrangement wherein one polymer is surrounded by another or may be a side by side arrangement or an "islands-in-the-sea" arrangement. Bicomponent fibers are taught in U.S. Pat. No. 5,108,820 to Kaneko, et al., U.S. Pat. No. 5,336,552 to Strack, et al., and European Patent No. 0586924. For two component fibers, the polymers may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compaticilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

SUMMARY OF THE INVENTION

The present invention recognizes and addresses the foregoing drawbacks and deficiencies of prior art constructions and methods.

Accordingly, it is an object of the present invention to provide an improved composition for producing more cloth-like fibrous webs from thermoplastic polymers.

It is another object of the present invention to provide more cloth-like fibers, including filaments, made from thermoplastic polymers.

It is another object of the present invention to provide more cloth-like nonwoven webs and laminates thereof made from thermoplastic polymers that have stiffness and softness characteristics that are comparable to fabrics made from natural fibers.

Still another object of the present invention is to provide more cloth-like fibers, webs and laminates made from thermoplastic polymers by incorporating into the polymers a mixture of fillers.

Another object of the present invention is to provide more cloth-like fibers, webs and laminates made from a thermoplastic polymer by incorporating into the polymer a mixture of mineral fillers, such as kaolin clay or calcium carbonate, and titanium dioxide.

These and other objects of the invention are achieved by providing a process for producing more cloth-like nonwoven webs from polymeric fibers with improved visual aesthetics. The cloth-like properties are produced by incorporating a mixture of fillers into a thermoplastic polymeric material. The mixture of fillers includes titanium dioxide and a mineral filler. The mineral filler is preferably calcium carbonate or kaolin clay. Other mineral fillers that may be used in the process include talc, gypsum, diatomaceous earth, other natural or synthetic clays, and mixtures thereof. Particular clays that may be used in the present invention besides kaolin, include attapulgite clay, bentonite clay, or montomorillonite clay.

Once the fillers are incorporated into the thermoplastic polymeric material, the polymer is formed into fibers. The fibers are then subsequently used to create a nonwoven web. The mixture of fillers incorporated into the polymeric material is added in an amount sufficient to decrease the stiffness and increase the softness of the web in comparison to nonwoven webs made from the thermoplastic polymeric material not containing any fillers.

In most applications, according to the present invention, the fibers are formed by extruding the thermoplastic polymeric material. For instance, the nonwoven web can be made from meltblown fibers or spunbond fibers. The thermoplastic polymeric material used to make the fibers can be, for instance, a polyolefin, a polyamide, such as nylon, a polyester, a mixture of the above polymers, and copolymers of the above polymers such as copolymers comprising propylene units. In one embodiment, the thermoplastic polymer is polypropylene or a copolymer containing polypropylene.

The amount of fillers added to the thermoplastic polymeric material will generally depend upon the particular application. For most applications, the mineral filler should be added to the polymeric material in an amount up to about 10% by weight, while the titanium dioxide can be added to the polymeric material in an amount up to about 4% by weight. More particularly, for most applications, the mineral filler will be added to the polymeric material in an amount from about 2.5% by weight to about 5% by weight, while the titanium dioxide will be added in an amount from about 1% by weight to about 2% by weight. In general, the fillers should be added to the polymer in an amount insufficient for the fillers to substantially protrude from the surface of the fibers. For instance, the surface of the fibers should not become rough due to the presence of the fillers.

In order to incorporate the fillers into the thermoplastic polymer, the fillers can be added to the polymer in combination with a vehicle, such as a low molecular weight wax. For example, in one embodiment, the vehicle can be a wax that is blended with the fillers prior to being added to the polymeric material. The wax can be, for instance, a low density, low molecular weight, polyethylene or polypropylene. The wax can be mixed with the fillers in an amount of about 50% by weight.

According to the present invention, it has been discovered that when a mineral filler in combination with titanium dioxide is added to a thermoplastic polymer during the formation of nonwoven webs, the webs have improved cloth-like properties, improved luster, and less gloss. For instance, it has been discovered that the nonwoven webs are softer and less stiff. The fillers also only minimally affect the strength or abrasion resistance of the nonwoven web or the fibers used to make the web. It has been further discovered that the fillers also improve the thermal aging stability of the web, which refers to the ability of the web to withstand high temperatures for a prolonged period of time without degrading.

These and other objects of the present invention are also achieved by providing fibers and webs made from the fibers. The fibers produced according to the present invention are designed to produce cloth-like webs useful for many diverse applications. The fibers are made from a thermoplastic polymer containing a mixture of fillers. The fillers include titanium dioxide and at least one mineral filler. The fillers are encapsulated within the thermoplastic polymer and are added in an amount insufficient for the fillers to protrude from the surface of the fibers.

The fibers produced can be discontinuous or continuous fibers and can be made according to a meltblown process or a spunbond process.

Other objects, features, and aspects of the present invention will be discussed in greater detail below.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to cloth-like webs made from thermoplastic polymers and to a process for producing the webs. The nonwoven webs are made from thermoplastic polymeric fibers. According to the present invention, a mixture of fillers is incorporated into the thermoplastic polymer that is used to make the fibers. The mixture of fillers not only makes nonwoven webs made from the fibers appear like cloth, but also provides the nonwoven webs with cloth-like properties.

In particular, the mixture of fillers added to the thermoplastic polymer has been found to produce nonwoven webs that are softer and less stiff than webs made from polymers not containing the fillers. Besides being softer and less stiff, it has been discovered that the nonwoven webs also have improved thermal aging stability, which refers to the ability of the web to withstand high temperatures for prolonged periods of time without degrading. It is believed that the fillers, in some applications, can also make the webs odor absorbent. Further, it has been discovered that the fillers do not adversely affect the strength of the webs, the abrasion resistance of the webs, and the bonding characteristics and fiber spinning characteristics of the polymer.

Nonwoven webs made according to the present invention can be used in many different applications. For instance, the nonwoven webs are well suited for use in such products as diapers, feminine hygiene products, wipers, towels, industrial garments, medical garments, medical drapes, medical gowns, foot covers, sterilization wraps, and various other products. The base webs can be used alone or can be combined with other webs to form laminates. In one preferred embodiment of the present invention, the nonwoven webs are used as facing fabrics for diapers and personal care articles. It should be understood, however, that the above listed goods are merely exemplary and that the base webs can be used in various other applications.

The mixture of fillers that is incorporated into a thermoplastic polymer in accordance with the present invention is a combination of titanium dioxide and at least one mineral filler. The mineral filler is preferably kaolin clay (which contains aluminum silicate hydroxide), calcium carbonate, talc, or attapulgite clay (which contains hydrated aluminum-magnesium silicate). It is believed, however, that many other mineral fillers may be used in the present invention including, for instance, synthetic clays. A single mineral filler or a combination of mineral fillers may be combined with the titanium dioxide and incorporated into the polymer.

Commercially available kaolin based materials that may be used in the process of the present invention include ECC 90, ECC 195, ECC 360, and ECC A-TEX 501 Ultra, which are all available from ECC International of Sandersville, Ga. ECC 90 is a delaminated 0.45 micron kaolin, while ECC 195 and ECC 360 have an average particle size of 0.25 microns and 0.45 microns respectively. ECC A-TEX 501 Ultra, which has demonstrated the best results thus far, is an anhydrous kaolin with an average particle size of about 0.2 microns. ECC A-TEX 501 Ultra is virtually moisture free.

Other commercially available kaolin materials include MIRAGLOSS 91 and ULTRAGLOSS 90, which are available from Engelhard Corporation of Iselin, N.J. Another kaolin material that has also performed very well is ANSILEX 93, which is also commercially available from the Engelhard Corporation. ANSILEX 93 is a calcined kaolin with 90% of the particles having a size of less than 2 microns.

Commercially available calcium carbonate products that may be used in the process of the present invention include: MAGNIUMGLOSS, available from the Mississippi Lime Company of Genevieve, Mo.; ALBAGLOSS, available from Speciality Minerals, Inc. of New York, N.Y.; and OMYACARB available from OMYA, Inc. of Proctor, Vt. In particular, MAGNIUMGLOSS calcium carbonate has a aragonite structure, ALBAGLOSS calcium carbonate has a calcite structure, while OMYACARB is a mined and surface treated calcium carbonate.

An example of a commercially available attapulgite clay that may be used in the present invention is ATTAGEL 50 which is marketed by the Engelhard Corporation. ATTAGEL 50 has an average particle size of about 0.1 microns and experiences about 12% weight loss at 105° C.

In general, the mineral filler used in the present invention can have various particle sizes and morphologies. Of particular advantage, it has been discovered that the properties of fibers made according to the present invention can be varied by varying the type of mineral filler used. In this manner, a particular mineral filler can be chosen having a selected particle size and morphology for producing fibers and webs having desired characteristics.

The amount of mineral filler and titanium dioxide added to the polymeric material in producing fibers and webs in accordance with the present invention can also vary. Preferably, however, the mixture of fillers should be added to the polymeric material in an amount so that the fillers become encapsulated within fibers made from the polymeric material. In other words, the fillers should not substantially protrude from the surface of the fiber formed from the polymer. In general, the amount added will depend upon the particular fillers used, the morphology of the fillers, the particle size of the fillers, the denier of the fibers formed, besides other various factors.

For most applications, the mineral filler can be added to the polymer in an amount from about 0.1% to about 10% by weight. More particularly, the mineral filler can be added in an amount from about 2.5% to about 5% by weight.

On the other hand, the amount of titanium dioxide added to the polymeric material in accordance with the present invention can range from about 0.5% to about 4% by weight, and particularly from about 1% to about 2% by weight. One of the primary purposes for adding titanium dioxide to the polymeric material in accordance with the present invention is not only to improve the physical properties of resulting fibers and webs, but also to produce webs having a more cloth-like appearance. Specifically, it has been discovered that titanium dioxide can remove the glossy appearance that is normally associated with polymeric webs. Thus, for most applications, the titanium dioxide should be present in an amount sufficient to improve the visual appearance of fibers and webs produced from the polymers. Too much titanium dioxide present within the polymer, however, may have an adverse affect upon the softness of webs produced from the polymer.

As described above, it has been discovered that by adding a mixture of at least one mineral filler and titanium dioxide to polymeric materials, fibers and webs made from the polymer have shown to be softer and less stiff than fibers and webs made from the polymer alone. Although unknown, it is believed that the mixture of fillers incorporated into the polymer actually changes the physical properties of the polymer. In particular, it is believed that the fillers modify the modulus of the fiber and fabric creating the enhanced, cloth-like properties.

Besides producing more cloth-like webs from polymeric materials, the mixture of fillers added to polymers in accordance with the present invention also improves the ability of the polymer to be extruded and drawn into fibers. For instance, it has been discovered that polymers containing the fillers can withstand higher draw forces. Thus far, spunbond fibers have been produced having a denier of from about 1 to about 3 dpf. It is believed, however, that fibers having a denier less than 1 can also be produced.

Besides adding mineral fillers and titanium dioxide to a polymeric material in accordance with the present invention, in some applications, it may also be desirable to add optical brighteners to the polymer. For instance, some mineral fillers, especially some clays, when added to a polymer can give the polymer a clay or ecru tone. In some embodiments, this color may be preferred. In other applications, however, it may be desirable to add optical brighteners to the polymer which can make the polymer appear whiter.

The thermoplastic polymer blended with the mixture of fillers in accordance with the present invention can vary and will generally depend upon the particular application. For most applications, a polyolefin polymer is used, such as controlled rheology polypropylene, polyethylene, and copolymers thereof. Other thermoplastic polymers, however, that are well suited for use in the process of the present invention include polyamides such as nylon, polyesters, blends of the above polymers, and copolymers of the above polymers.

In one embodiment, the thermoplastic polymer comprises a blend of polymers, such as controlled rheology polypropylene blended with a polyamide or a reactor grade polypropylene. For instance, in one embodiment, polypropylene is blended with from about 2% to about 5% by weight of a polyamide. The polymer combination above is also believed to improve the strength of the fibers and to further improve the cloth-like qualities of the resulting webs. Blending polypropylene with a polyamide to produce strong, soft, nonwoven fabrics is disclosed in U.S. patent application Ser. No. 08/769,820 filed by the assignee of the present invention, and which is incorporated herein by reference.

Commercially available polymers that may be used include PF 305 polypropylene, which is marketed by Montell USA, Inc. of Wilmington, Del.; E5D47 polypropylene, which is marketed by Union Carbide; and 6D43 polypropylene-polyethylene copolymer which is also marketed by Union Carbide. PF 305 polypropylene and E5D47 polypropylene both have a meltflow rating of about 38 g/10 min. 6D43 copolymer, which contains ethylene in an amount of about 3.2%, on the other hand, has a meltflow rating of about 35 g/10 min when measured at 230° C. according to ASTM D1238 condition E test.

The polymer and filler combination of the present invention can be used to form discontinuous fibers and continuous fibers, which include spunbond filaments. Further, the fibers can be single component fibers or multicomponent fibers, such as bicomponent fibers.

In general, the mixture of fillers is combined with the thermoplastic polymer prior to or during formation of the fibers. In one embodiment, the fillers are melt blended with the thermoplastic polymer prior to extruding the polymer into fibers. In some applications, a vehicle, such as a wax, may be blended with the filler prior to combining the filler with the polymer.

For example, wax that may be used in the present invention include low density, low molecular weight polymers, such as polyethylene or polypropylene. In one embodiment, the vehicle can be mixed with the fillers in a weight ratio of about 1 to 1 prior to addition to the thermoplastic polymer. Of particular advantage, some waxes, such as low density polyethylene, have also been discovered to somewhat enhance the softness of the resulting polymer.

Besides using a wax, fillers can also be used that are coated with an organic material. For instance, the filler particles can be coated with stearic acid, which provides better dispersion of the filler in the polymer melt and facilitates production of the fibers.

Once the fillers of the present invention are mixed with the polymer, the polymer can be formed into fibers according to, for instance, a spunbond process or a meltblown process. For instance, in a spunbond process, the polymer and filler blend can be melt-spun into fibers by pumping the polymer blend through a multitude of capillaries arranged in a uniform array of columns and rows. Although the extrusion rate and temperature can vary dramatically depending upon the application, for most applications the polymer blend will be spun at a rate of from about 0.4 g/min. to about 2.5 g/min. and at a temperature of from about 180° C. to about 235° C.

After extrusion, the fibers are attenuated by high velocity air. The air creates a draw force on the fibers that draws them down to a desired denier. After attenuation, the draw fibers are directed onto a foraminous surface, such as a moving screen or forming wire. The fibers are randomly deposited on the foraminous surface so as to form a sheet. The sheet can be held on the foraminous surface by a vacuum force.

Once formed, the sheet of fibers can then be bonded as desired. For instance, examples of different methods for bonding the sheet includes thermal point bonding, ultrasonic bonding, hydroentanglement and through-air bonding.

Thermal point bonding is quite common and involves passing a fabric or web of fibers to be bonded through a heated calender roll and an anvil roll. The calender roll is usually patterned in some way so that the entire fabric is not bonded across its entire surface. Various patterns can be used in the process of the present invention without affecting the mechanical properties of the web. For instance, the web can be bonded according to a ribbed knit pattern, a wire weave pattern, a diamond pattern, and the like.

After being bonded, the resulting web can be post-treated if desired. For instance, the web can undergo a machine direction orientation process, a creping process, a hydroentanglement process or an embossing process. It has been discovered that the combination of fillers added to the web in accordance with the present invention further improve the appearance of a web after any of the above post-treatment processes, especially in relation to webs that contain only titanium dioxide. In particular, after post-treatment, it has been discovered that the webs appear more cloth-like than conventional webs.

Besides spunbond webs, the polymer blend of the present invention can also be used to produce meltblown fabrics. Meltblown fabrics can be produced by extruding the polymer blend through a die to form fibers. As the molten polymer fibers exit the die, a high pressure fluid, such as heated air or steam, can be used to attenuate the molten polymer fibers. Surrounding cool air can then be induced into the hot air stream for cooling and solidifying the fibers. The fibers are then randomly deposited onto a foraminous surface to form a web. Since the fibers can be partially melted when deposited onto the foraminous surface, the web has initial integrity. If desired, however, the web can be additionally bonded, similar to the bonding process described above regarding the formation of spunbond webs.

The present invention may be better understood with reference to the following examples.

During each of the following examples, routine test methodology was used to test the properties of interest for each of the web samples produced. A short description of each test follows:

Basis Weight:

Basis Weight is the mass of material per unit area and is measured according to ASTM test number D3776-96 Option C. Basis weight is measured in ounces/yard$^2$.

Strength:

The Grab Tensile test is a measure of breaking strength and elongation or strain of a fabric when subjected to unidirectional stress. This test is known in the art and conforms to the specifications of Method 5100 of the Federal Test Methods Standard No. 191A. The results are expressed in pounds or grams to break and percent stretch before breakage. Higher numbers indicate a stronger, more stretchable fabric. The term "load" means the maximum load or force, expressed in units of weight, required to break or rupture the specimen in a tensile test. The term "strain" or "total energy" means the total energy under a load versus elongation curve as expressed in weight-length units. The term "elongation" means the increase in length of a specimen during a tensile test. The grab tensile test uses two clamps, each having two jaws with each jaw having a facing in contact with the sample. The clamps hold the material in the same plane, usually vertically, separated by 3 inches (76 mm) and move apart at a specified rate of extension. Values for grab tensile strength and grab elongation are obtained using a sample size of 4 inches (102 mm) by 6 inches (152 mm), with a jaw facing size of 1 inch (25 mm) by 1 inch, and a constant rate of extension of 300 mm/min. The sample is wider than the clamp jaws to give results representative of effective strength of fibers in the clamped width combined with additional strength contributed by adjacent fibers in the fabric. The specimen is clamped in, for example, a Sintech 2 Tester available from the Sintech Corporation of Cary, N.C., an Instron Model TM, available from the Instron Corporation, Canton, Mass., or a Thwing-Albert Model INTELLECT II available from the Thwing-Albert Instrument Company, Philadelphia, Pa. This closely simulates fabric stress conditions in actual use. Results are reported as an average of three specimens and may be performed with the specimen in the cross direction (CD) or the machine direction (MD).

Trap Tear Test:

The trapezoid or "trap" tear test is a tension test applicable to both woven and nonwoven fabrics. The entire width of the specimen is gripped between clamps, thus the test primarily measures the bonding or interlocking and strength of individual fibers directly in the tensile load, rather than the strength of the composite structure of the fabric as a whole. The procedure is useful in estimating the relative ease of tearing a fabric. It is particularly useful in the determination of any appreciable difference in strength between the machine and cross direction of the fabric.

In conducting the trap tear test, an outline of a trapezoid is drawn on a 3 by 6 inch (75 by 152 mm) specimen with the longer dimension in the direction being tested, and the specimen is cut in the shape of the trapezoid. The trapezoid has a 4 inch (102 mm) side and a 1 inch (25 mm) side which are parallel and which are separated by 3 inches (76 mm). A small preliminary cut of ⅝ inches (15 mm) is made in the middle of the shorter of the parallel sides. The specimens is clamped in, for example, an Instron Model TM, available from the Instron Corporation, Canton, Mass., or a Thwing-Albert Model INTELLECT II available from the Thwing-Albert Instrument Co., Philadelphia, Pa., which have 3 inch (76 mm) long parallel clamps. The specimen is clamped along the non-parallel sides of the trapezoid so that the fabric on the longer side is loose and the fabric along the shorter side taut, and with the cut halfway between the clamps. A continuous load is applied on the specimen such that the tear propagates across the specimen width. It should be noted that the longer direction is the direction being tested even though the tear is perpendicular to the length of the specimen. The force required to completely tear the specimen is recorded in pounds with higher numbers indicating a greater resistance to tearing. The test method used conforms to ASTM Standard test D-1117-14 except that the tearing load is calculated as the average of the first and highest peaks recorded rather than the lowest and highest peaks. Five specimens for each sample should be tested.

Softness:

The softness of a nonwoven fabric may be measured according to the "cup crush" test. The cup test evaluates fabric stiffness by measuring the peak load required for a 4.5 cm diameter hemispherically shaped foot to crush a 23 cm by 23 cm piece of fabric shaped into an approximately 6.5 cm diameter by 6.5 cm tall inverted cup while the cup shaped fabric is surrounded by an approximately 6.5 cm diameter cylinder to maintain a uniform deformation of the cup shaped fabric. An average of 10 readings is used. The foot and the cup are aligned to avoid contact between the cup walls and the foot which could affect the readings. The peak load is measured while the foot is descending at a rate of about 0.25 inches per second (38 cm per minute) and is measured in grams. A lower cup crush value indicates a softer laminate. The cup crush test also yields a value for the total energy required to crush a sample (the "cup crush energy") which is the energy from the start of the test to the peak load point, i.e. the area under the curve formed by the load in grams on one axis and the distance the foot travels in millimeters on the other. Cup crush energy is reported in gm-mm. A suitable device for measuring cup crush is a model FTD-G500 load cell (500 gm range) available from the Schaevitz Company, Pennsauken, N.J.

The Drape test was also used to determine the stiffness of the materials. The drape stiffness test, also sometimes called the cantilever bending test, determines the bending length of a fabric using the principle of cantilever bending of the fabric under its own weight. The bending length is a measure of the interaction between fabric weight and fabric stiffness. A 1 inch (2.54 cm) by 8 inch (20.3 cm) fabric strip is slid, at 4.75 inches per minute (12 cm min) in a direction parallels to its long dimension so that its leading edge projects from the edge of a horizontal surface. The length of the overhand is measured when the tip of the specimen is depressed under its own weight to the point where the line joining the tip of the fabric to the edge of the platform makes a 41.5 degree angle with the horizontal. The longer the overhang the slower the specimen was to bend, indicating a stiffer fabric. The drape stiffness is calculated as 0.5×bending length. A total of 5 samples of each fabric should be taken. This procedure conforms to ASTM standard test D-1388 except for the fabric length which is different (longer) and Method 5206 Federal Test Method Standard No. 191 A. The test equipment used is a Cantilever Bending tester model 79-10 available from Testing Machines, Inc., 400 Bayview Avenue, Amityville, N.Y. 11701. As in most testing, the sample should not be conditioned to ASTM of 65+2 in relative humidity and 72+2° F. (22+1° C.), or TAPPI conditions of 50+2 percent relative humidity and 72+1.8° F. prior to testing.

Handle-O-Meter:

The softness of a nonwoven fabric may be measured according to the "Handle-O-Meter" test. The test used herein is the INDA standard test 1st 90.0-75 (R 82) with two modifications: 1. the specimen size was 4 inches by 4 inches and; 2. five specimens were tested rather than two. The test was carried out on Handle-O-Meter model number 211-5 from the Thwing-Albert Instrument Co., Philadelphia, Pa.

Abrasion:

The Taber Abrasion test indicates fabric durability against abrasion. The test used herein conforms to method 5306, Federal Test Methods Standard No. 191A and ASTM Standard Test No. D 1175 (using a double wheel). The fabric is subjected to a repetitive rotary rubbing action under controlled pressure and abrasive action. After a specified number of cycles, the abraded fabric is rated visually against a set of control photographs by a system in which 1 signifies severe abrasion and 5 signifies the least abrasion.

In the Martendale test, the specimen is abraded while the direction of the abrader is continuously changing. This test measures the relative resistance to abrasion of a fabric. The test results are reported on a scale of 1 to 5 with 5 being the least wear and 1 the most, after 120 cycles with a weight of 1.3 pounds per square inch. The test is carried out with Martindate Tear and Abrasion Tester such as model no. 103 or model no. 403 available from James H. Heal Company, Ltd. of Yorkshire, England. The abradant used is a 36 inch by 4 inch by 0.05 thick silicone rubber wheel reinforced with fiber glass having a rubber surface hardness 81A Durometer, Shore A of 81 plus or minus 9. The abradant is available from Flight Insulation, Inc., a distributor for Connecticut Hard Rubber, 925 Industrial Park, NE, Marietta, Ga. 30065.

The Reciprocation Abrasion test is used to assess abrasion and surface bond integrity of material. Poorly bonded material will exhibit surface roping and fuzzing. Tested material is compared to standard photographs and rated either 1, 3, or 5, with 1 signaling the most roping or fuzzing.

Absorption:

The Water and Oil Absorption Capacity test is used to determine the capacity of a fabric to absorb either water or mineral oil, but the test is applicable to other liquids as well. The test used herein conforms to ASTM Test No. D 1117.5.3-80. Absorption is determined as the weight of the liquid absorbed by the specimen and as a percentage of the specimen's unit weight. Higher results indicate a greater absorption capacity of the sample.

Color:

The Hunter Color test measures the color values of a given fabric using a colorimeter with illumination provided by a standard CIE source and reports data observed under simulated overcast sky daylight conditions.

Whiteness as used herein is meausred according to ASTM methods E3313-73 D 1925-70 on a Hunter Color Meter Model D25A9 with a CIE source C illumination. Gloss as used herein is measured in accordance with ASTM 523 on a D48-7 Hunterlab Modular glossmeter using 60° gloss vaules.

EXAMPLE NO. 1

The tests described above were performed in order to demonstrate the strength, softness, and durability of fibrous webs made according to the present invention.

Eight (8) different web products were produced and tested. The webs tested were made from a random copolymer comprising 97% polypropylene and 3% polyethylene. The samples were as follows:

TABLE 1

| Sample | Sample No. |
|---|---|
| random copolymer | 1 |
| random copolymer and 2% $TiO_2$ | 2 |
| random copolymer and 5% wax | 3 |
| random copolymer, 5% wax, and 2% $TiO_2$ | 4 |
| random copolymer, 5% wax and 5% $CaCO_3$ (Calcite) | 5 |
| random copolymer, 5% wax, 5% $CaCO_3$ (Calcite), and 2% $TiO_2$ | 6 |
| random copolymer, 5% wax and 5% $CaCO_3$ (Aragonite) | 7 |
| random copolymer, 5% wax, 5% $CaCO_3$ (Aragonite), and 2% $TiO_2$ | 8 |

The random copolymer used in this example was 6D43 polymer obtained from Union Carbide. In the above table, the wax refers to a linear, low density polyethylene marketed as AC16 by Allied Signal of Morristown, N.J. The calcium carbonate having the calcite structure used in the samples was ALBAGLOSS filler obtained from Specialty Mineral, Inc., while the calcium carbonate having the ARAGONITE structure used in the samples was MAGNUM GLOSS filler obtained from the Mississippi Lime Company. Titanium dioxide was incorporated into the samples in a 50% concentrate of titanium dioxide in a 35 meltflow rate controlled rheology polypropylene.

The above samples were made into fibers through a spunbond process and formed into nonwoven webs. The spinning conditions and the bonding temperature were not optimized but were constant for all the samples. The basis weight of each sample was approximately 1 oz/yd$^2$. Once the web was formed, a bonded pattern was embossed into the fabrics using bond rollers. The denier of the fibers produced ranged from about 2.0 to about 2.5. Various tests were performed on each of the samples. The following results were obtained:

TABLE 2

| Sample No. | 1 | 2 | 3 | 4 | 5 | 6 | 7 | 8 |
|---|---|---|---|---|---|---|---|---|
| MD Trap. Tear (lbs.) | 4.7 | 5.0 | 3.6 | 5.8 | 3.8 | 5.4 | 5.5 | 5.0 |
| CD Trap. Tear (lbs.) | 3.4 | 4.5 | 2.6 | 3.2 | 3.5 | 3.1 | 3.7 | 4.1 |
| MD Peak Tensile Load from Grab Tensile (lbs.) | 8.7 | 12.4 | 8.0 | 9.5 | 9.3 | 10.5 | 9.6 | 10.4 |
| CD Peak Load from Grab Tensile (lbs.) | 7.7 | 9.5 | 4.9 | 7.6 | 7.8 | 6.9 | 9.1 | 7.7 |
| MD Strain (%) | 54 | 51 | 60 | 68 | 60 | 56 | 73 | 69 |
| CD Strain (%) | 98 | 92 | 103 | 88 | 90 | 94 | 93 | 77 |
| MD Grab Tensile Energy (lbs./in.) | 9 | 12 | 10 | 12 | 11 | 12 | 12 | 13 |
| CD Grab Tensile Energy (lbs./in.) | 13 | 15 | 7 | 10 | 11 | 10 | 14 | 10 |
| Cup Crush (g) | 44 | 61 | 31 | 35 | 37 | 39 | 46 | 41 |
| Cup Crush Energy (g/mm) | 841 | 1117 | 503 | 706 | 643 | 714 | 785 | 712 |
| MD Drape Bending (cm) | 2.6 | 2.6 | 2.4 | 2.3 | 2.6 | 2.5 | 2.5 | 2.3 |
| CD Drape Bending (cm) | 1.3 | 1.5 | 1.2 | 1.3 | 1.5 | 1.4 | 1.6 | 1.8 |
| MD Handle-O-Meter (g) | 13.3 | 19.4 | 11.0 | 12.7 | 11.5 | 12.9 | 10.7 | 11.6 |
| CD Handle-O-Meter (g) | 4.5 | 8.4 | 3.5 | 4.1 | 5.4 | 3.7 | 4.8 | 5.8 |
| Taber Abrasion after 25 cycles | 2.3 | 2.3 | 2.4 | 1.8 | 2.4 | 1.8 | 2.8 | 2.2 |
| Taber Abrasion rating after 50 cycles | 1.3 | 1.3 | 1.6 | 1.6 | 2.2 | 1.2 | 2.6 | 2.2 |
| Reciprocation Abrasion rating | 3.0 | 3.5 | 3.2 | 4.0 | 4.0 | 4.0 | 4.0 | 4.0 |

From the above data, a number of generalities were observed. For instance, the addition of titanium dioxide to the polymer tended to make the fabric stronger and stiffer. The addition of wax, however, tended to nullify the negative effect of titanium dioxide on softness. The wax, however, tended to reduce the strength of the fabric when added in larger amounts.

The addition of calcium carbonate having a calcite structure decreased trap tear peak load but increased grab tensile peak load suggesting that fiber strength may be decreased while composite, fabric strength is increased. Calcium carbonate having the aragonite structure, on the other hand, tended to increase both trap tear peak load and grab tensile peak load. The addition of calcium carbonate to the polymer also tended to increase softness.

EXAMPLE NO. 2

Spunbond webs were made according to the procedure described in Example 1. In this example, however, instead of using a random copolymer, the webs were made from polypropylene.

Six (6) different web products were produced and tested. The samples are as follows:

TABLE 3

| Sample | Sample No. |
|---|---|
| polypropylene | 1 |
| polypropylene and 2% $TiO_2$ | 2 |
| polypropylene and 4% $TiO_2$ | 3 |
| polypropylene, 5% wax, 5% kaolin, and 2% $TiO_2$ | 4 |
| polypropylene, 5% wax, 5% kaolin (0.6 ghm), and 2% $TiO_2$ | 5 |
| polypropylene, 5% wax, 5% $CaCO_3$ (Aragonite), and 2% $TiO_2$ | 6 |

The polypropylene used above was PF305 obtained from Montell USA, Inc. and had a meltflow rating of 38 g/10 min. The kaolin listed above was obtained from ECC, Inc. When making the spunbond fibers, the polymer was extruded at a rate of 0.7 ghm, except for sample number 5 which was extruded at a rate of 0.6 ghm.

The same conventional methods used for the testing procedures in Example 1 were used to test these polypropylene products. The following results were obtained:

TABLE 4

| Sample No. | 1 | 2 | 3 | 4 | 5 | 6 |
|---|---|---|---|---|---|---|
| MD Trap. Tear (lbs.) | 7.43 | 6.90 | 8.78 | 7.65 | 7.21 | 5.09 |
| CD Trap. Tear (lbs.) | 5.04 | 5.47 | 5.47 | 5.49 | 4.74 | 4.21 |
| MD Tensile (lbs.) | 15.05 | 15.54 | 18.30 | 14.41 | 15.15 | 11.96 |
| CD Tensile (lbs.) | 10.56 | 11.60 | 11.32 | 10.07 | 10.65 | 8.81 |
| MD Tensile Energy (lbs./area) | 16.19 | 15.17 | 19.13 | 16.51 | 18.22 | 13.71 |
| CD Tensile Energy (lbs./area) | 10.15 | 12.87 | 10.61 | 10.59 | 14.19 | 10.37 |
| Cup Crush (g) | 85 | 84 | 90 | 65 | 60 | 63 |
| Cup Crush Energy (g/mm) | 1416 | 1549 | 1573 | 1158 | 1056 | 1083 |
| MD Drape Bending (cm) | 3.0 | 3.2 | 3.5 | 2.8 | 3.0 | 2.7 |
| CD Drape Bending (cm) | 2.5 | 2.0 | 2.2 | 2.0 | 2.0 | 1.9 |
| MD Handle-O-Meter (g) | 28 | 35 | 33 | 25 | 27 | 22 |
| CD Handle-O-Meter (g) | 14 | 19 | 17 | 11 | 13 | 12 |
| Taber Abrasion after 25 cycles | 3.00 | 2.80 | 2.40 | 2.00 | 2.20 | 2.20 |
| Taber Abrasion after 50 cycles | 2.40 | 2.00 | 2.00 | 1.40 | 1.60 | 1.01 |
| Martendale Abrasion Rating | 3.60 | 3.40 | 3.60 | 3.80 | 4.00 | 4.00 |
| Reciprocation Abrasion rating | 4.20 | 5.00 | 4.60 | 5.00 | 5.00 | 5.00 |

As shown above, the addition of titanium dioxide to polypropylene appears to decrease softness. Addition of calcium carbonate or kaolin, however, reversed the effects of titanium dioxide and increased softness. During the tests, it was also visually noticed that the addition of titanium dioxide gave the resulting webs a more cloth-like appearance.

EXAMPLE NO. 3

Spunbond nonwoven webs were made in accordance with the procedures described in Example 1 from the polypropylene polymer identified in Example 2. In this example, the bonding temperature of the fabric products was varied in order to optimize results. Three (3) different web products were produced and subsequently tested at several different bonding temperatures. The samples and a list of their components are listed below.

TABLE 5

| Sample | Sample No. |
|---|---|
| Polypropylene and 2% $TiO_2$ | 1 |
| Polypropylene, 2.5% wax, 2.5% Kaolin, and 2% $TiO_2$ | 2 |
| Polypropylene, 5% wax, 5% Kaolin, and 2% $TiO_2$ | 3 |

The samples were tested as described above and the following results were obtained:

TABLE 6

| | Sample No. 1 | | | Sample No. 2 | | | Sample No. 3 | | | |
|---|---|---|---|---|---|---|---|---|---|---|
| Bonding Temperature (° F.) | 267 | 289 | 302 | 264 | 275 | 303 | 250 | 285 | 295 | 305 |
| Cup Crush (g) | 94.6 | 98.2 | 109.0 | 68.1 | 72.1 | 77.4 | 61.5 | 64.7 | 66.7 | 66.9 |
| Cup Crush Energy (g/mm) | 1680 | 1750 | 1940 | 1130 | 1190 | 1450 | 986 | 1110 | 1170 | 1200 |
| MD Drape Bending (cm) | 3.02 | 3.04 | 2.93 | 2.5 | 1.92 | 3.02 | 2.62 | 2.53 | 2.72 | 2.46 |
| CD Drape Bending (cm) | 2.05 | 2.14 | 1.82 | 2.14 | 1.77 | 1.7 | 1.68 | 2 | 2 | 1.97 |
| MD Handle-O-Meter (g) | 19.1 | 24.4 | 24.3 | 12.5 | 18.1 | 23.4 | 12.8 | 14.7 | 16.7 | 18.0 |
| CD Handle-O-Meter (g) | 8.82 | 12.0 | 12.7 | 5.5 | 8.1 | 9.6 | 6.3 | 7.4 | 7.9 | 11.1 |
| MD Tensile (lbs.) | 12.9 | 17.6 | 18.4 | 10.7 | 12.8 | 13.7 | 8.6 | 11.2 | 13.3 | 9.2 |
| CD Tensile (lbs.) | 8.9 | 10.3 | 13.6 | 7.4 | 9.4 | 10.4 | 6.5 | 8.6 | 9.7 | 8.3 |
| MD Strain (%) | 41 | 52 | 50 | 41 | 47 | 44 | 40 | 52 | 57 | 39 |
| CD Strain (%) | 52 | 60 | 70 | 61 | 69 | 66 | 63 | 67 | 73 | 59 |
| MD Tensile Energy (lbs./in.) | 9.5 | 16.3 | 16.7 | 7.7 | 10.6 | 11.2 | 6.0 | 10.9 | 13.8 | 7.0 |
| CD Tensile Energy (lbs./in.) | 7.7 | 10.2 | 15.9 | 7.8 | 10.8 | 11.6 | 7.3 | 9.8 | 11.9 | 8.3 |

As shown above, in general, softness increases at lower bonding temperatures, while strength increases at higher bonding temperatures. In this example, as shown above, softness dramatically increased when a mineral filler was added to the polypropylene.

EXAMPLE NO. 4

The following experiments were conducted in order to demonstrate the effects of the addition of wax to the web products. Five (5) different web products were produced from spunbond polypropylene fibers similar to the procedures described in Examples Nos. 1 and 2. The samples and a list of their components are listed below. During production of the nonwoven webs, bonding temperature was again varied in order to optimize results.

TABLE 7

| Sample | Sample No. |
|---|---|
| Polypropylene, 2.5% Polyethylene (wax), and 2% $TiO_2$ | 1 |
| Polypropylene, 2.5% Polyethylene (wax), 2.5% Kaolin, and 2% $TiO_2$ | 2 |
| Polypropylene, 2.5% Kaolin, and 2% $TiO_2$ | 3 |

TABLE 7-continued

| Sample | Sample No. |
|---|---|
| Polypropylene, 2.5% polypropylene wax, and 2% $TiO_2$ | 4 |
| Polypropylene and 2% $TiO_2$ | 5 |

The same conventional methods described above were used to test these samples. The following results were obtained:

TABLE 8

| | Sample No. 1 | | | | Sample No. 2 | | | | Sample No. 3 | | | | Sample No. 4 | | | | Sample No. 5 |
|---|---|---|---|---|---|---|---|---|---|---|---|---|---|---|---|---|---|
| Bonding Temperature (° F.) | 270 | 280 | 290 | 300 | 270 | 280 | 290 | 300 | 280 | 290 | 300 | 310 | 270 | 280 | 290 | 300 | 305 |
| MD Tensile (lbs.) | 11.6 | 12.5 | 14.0 | 13.9 | 11.4 | 13.1 | 13.4 | 14.1 | 14.8 | 15.9 | 15.9 | 13.4 | 15.7 | 16.9 | 17.5 | 17.2 | 17.2 |
| CD Tensile (lbs.) | 8.6 | 9.1 | 10.8 | 10.9 | 8.3 | 8.4 | 9.6 | 9.5 | 9.7 | 10.0 | 10.8 | 10.4 | 11.6 | 12.0 | 13.0 | 13.3 | 13.3 |
| MD Strain (%) | 46 | 45 | 51 | 48 | 42 | 46 | 45 | 45 | 48 | 53 | 46 | 38 | 46 | 50 | 49 | 45 | 41 |
| CD Strain (%) | 60 | 65 | 68 | 69 | 63 | 65 | 70 | 66 | 65 | 68 | 69 | 65 | 68 | 69 | 70 | 74 | 63 |
| MD Tensile Energy (lbs./in.) | 9.1 | 9.8 | 12.3 | 11.8 | 8.2 | 10.7 | 10.5 | 11.4 | 12.4 | 15.0 | 13.0 | 9.1 | 12.7 | 14.9 | 15.2 | 14.3 | 12.7 |
| CD Tensile Energy (lbs./in.) | 8.6 | 9.6 | 11.7 | 11.6 | 8.7 | 8.8 | 11.0 | 10.0 | 9.9 | 11.1 | 12.2 | 11.0 | 12.8 | 13.1 | 14.7 | 15.7 | 13.7 |
| MD Trap. Tear (lbs.) | 3.9 | 5.0 | 4.7 | 5.6 | 4.3 | 4.7 | 5.6 | 5.6 | 5.8 | 6.3 | 5.7 | 5.7 | 6.2 | 6.5 | 7.5 | 6.3 | 5.8 |
| CD Trap. Tear (lbs.) | 3.0 | 3.6 | 3.8 | 4.1 | 2.7 | 3.1 | 3.3 | 3.7 | 3.6 | 4.2 | 4.2 | 3.8 | 3.9 | 4.2 | 5.2 | 4.4 | 4.4 |
| Cup Crush (g) | 93 | 87 | 95 | 93 | 79 | 82 | 80 | 84 | 88 | 90 | 96 | 100 | 105 | 102 | 111 | 115 | 132 |
| Cup Crush Energy (g/mm) | 1519 | 1447 | 1569 | 1525 | 1282 | 1265 | 1263 | 1398 | 1459 | 1450 | 1622 | 1660 | 1844 | 1862 | 1984 | 2123 | 2398 |
| Basis Weight (oz/yd$^2$) | 1.00 | 1.03 | 1.03 | 1.01 | 1.06 | 1.03 | 1.05 | 1.02 | 1.03 | 1.08 | 1.06 | 1.06 | 1.09 | 1.07 | 1.09 | 1.07 | 1.08 |

As shown above, the inclusion of polyethylene wax to the mixture increased the softness of the web but also decreased the strength. Sample No. 3 made in accordance with the present invention also shows an increase in softness. The tensile strength of Example No. 3 however, is greater in comparison to Examples Nos. 1 and 2.

EXAMPLE NO. 5

The following example was conducted in order to show the effects of $TiO_2$ and clay on the gloss and whiteness of spunbond webs made similar to procedures described in Examples Nos. 1 and 2 above.

TABLE 10

| Sample | Sample No. |
|---|---|
| Polypropylene and 2% $TiO_2$ | 1 |
| Polypropylene, 2% $TiO_2$, and 2.5% Kaolin | 2 |
| Polypropylene, 2% $TiO_2$, and 5% Kaolin | 3 |

These fabrics were tested for gloss, and the following results were obtained:

TABLE 11

| Sample No. | 1 | | | 2 | | | 3 | | |
|---|---|---|---|---|---|---|---|---|---|
| Bonding Temperature (° F.) | 267 | 289 | 302 | 264 | 275 | 302 | 285 | 296 | 305 |
| Average Gloss Reading | 4.0 | 3.5 | 3.5 | 2.6 | 2.7 | 2.9 | 2.5 | 2.5 | 2.9 |

Gloss is defined as the light reflected specularly by a material. It can also be termed surface luster or brightness. Gloss is a geometric attribute of appearance, which is associated with the distribution of light from the object. Testing was done using the Hunterlab Modular Glossmeter D48-7. Higher results from the glossmeter indicate a greater amount of light reflected from the material.

Whiteness and yellowness indices were determined for the fabrics by using the Hunterlab Tristimulus Colorimeter D25A-9. Whiteness is based on a bluish white, the preferred white, and is reduced by traces of yellow and gray. Yellowness is caused by absorption in the blue part of the spectrum.

The two components of $TiO_2$ and a mineral filler such as clay work together in reducing gloss and giving the web a more cloth-like appearance. This combination of $TiO_2$ and mineral fillers is essential for aesthetic gain over conventional polypropylene webs as well as for improved softness. This is because $TiO_2$ significantly lowers gloss by itself while the mineral combination found in the clay further lowers gloss and greatly improves the softness of the material.

A sample of well-bonded polypropylene fabric was tested for gloss and whiteness before and after the addition of $TiO_2$ and Kaolin. The following results were obtained:

TABLE 9

| Sample | Gloss | Whiteness |
|---|---|---|
| Polypropylene | 11 | — |
| Polypropylene and 2% $TiO_2$ | 3.5 | 85 |
| Polypropylene, 2% $TiO_2$, and 2.5% Kaolin | 2.9 | 81 |
| Polypropylene, 2% $TiO_2$, and 5% Kaolin | 2.5 | 79 |

The effect of lowering the gloss of polypropylene fabrics can also be seen in another set of data collected for fabrics produced at different bonding temperatures. Three (3) different spunbond web products were produced and tested. The samples, their components, and their corresponding sample numbers are listed in Table 10 below.

As shown above, the addition of titanium dioxide dramatically reduces the gloss of polypropylene. The addition of a mineral filler, however, further decreased the gloss of the fabrics. Low gloss fabrics have a more cloth-like appearance.

During the trial, it was observed that as greater amounts of clay were added to the webs, the webs tended to exhibit more of a ecru-clay tone or tint. In some applications, this color is desirable. If a whiter appearing web is preferred, however, optical brighteners can be added or the clay can be replaced with calcium carbonate.

EXAMPLE NO. 6

Spunbond nonwoven webs were made in accordance with the procedures described in Example 1 with a polypropylene polymer. In this example, the affects of post treating a web by orienting the fibers contained within a bonded web in the machine direction were studied. The samples and a list of their components are listed below.

TABLE 12

| SAMPLE | SAMPLE NO. |
|---|---|
| polypropylene and 2% $TiO_2$ | 1 |
| polypropylene, 2.5% kaolin and 2% $TiO_2$ | 2 |
| polypropylene, 5% kaolin and 2% $TiO_2$ | 3 |

Each of the above samples were subjected to a machine direction orientation (MDO) treatment sometimes referred to as "necking" or "neck stretching". In particular, the samples were stretched in the machine direction using rolls. The stretching caused the fibers contained within the webs to orient in the machine direction. This mechanical treatment of the webs is more particularly described in U.S. patent application Ser. No. 08/639,637 owned by the assignee of the present invention, and which is incorporated herein by reference.

Each of the samples listed above were measured for softness. In particular, for each sample, a web was tested that had been subjected to the machine direction orientation described above and a web was tested that was not subjected to such treatment. The following results were obtained:

TABLE 13

| SAMPLE NO. | CUP CRUSH LOAD (g) | CUP CRUSH ENERGY (g/mm) |
|---|---|---|
| 1 | 91 | 1852 |
| 2 | 80 | 1332 |
| 3 | 67 | 1207 |
| 1 + MDO | 66 | 1135 |
| 2 + MDO | 51 | 815 |
| 3 + MDO | 40 | 693 |

As shown, the machine direction orientation treatment further increased the softness of the webs.

EXAMPLE NO. 7

Spunbond nonwoven webs were made in accordance with the procedures described in Example No. 1 from the polypropylene polymer identified in Example No. 2. In this example, the long term heat aging characteristics of webs made in accordance with the present invention were studied. Three different web products were produced and tested. The samples and the list of their components are as follows:

TABLE 14

| Sample | Sample No. |
|---|---|
| Polypropylene and 2% $TiO_2$ | 1 |
| Polypropylene, 5% polyethylene wax, 2% $TiO_2$ and 5% Kaolin | 2 |
| Polypropylene, 5% polyethylene wax, 2% $TiO_2$ and 5% Aragonite (calcium carbonate) | 3 |

The above webs were cut into samples having dimensions of approximately 3 inches by 6 inches. At least 3 specimens of each sample were tested. Thermal aging stability was tested by placing each sample in a forced-air oven set at a temperature of 140° C. The samples were laid flat in a PYREX dish and periodically tested until failure occurred. The failure point for the test was when the fabric became so brittle that the fabric disintegrated when a small force was exerted on the fabric in the cross machine direction.

The following results were obtained:

TABLE 15

| Sample No. | Time to Embrittlement (hrs.) |
|---|---|
| 1 | 27 |
| 2 | 53 |
| 3 | 53 |

As shown above, the filler formulation of the present invention greatly improved the thermal aging stability of the webs in comparison to a web containing only titanium dioxide.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for producing a nonwoven web from polymeric fibers, said process comprising the steps of:

incorporating into a thermoplastic polymer a mixture of fillers, said mixture of fillers comprising titanium dioxide and a mineral filler, the thermoplastic polymer comprising a mixture of at least a first polymer and a second polymer, the first and second polymers being selected from the group consisting of polyolefins, polyamides, polyesters, and copolymers thereof;

wherein said mixture of fillers is added to said thermoplastic polymer in an amount insufficient for said fillers to substantially protrude from the surface of said formed fibers;

said titanium dioxide being added to said thermoplastic polymer in an amount from about 0.5% to about 4% by weight and said mineral filler being added to said thermoplastic polymer in an amount from about 0.1% to about 10% by weight;

forming said thermoplastic polymer into fibers; and creating a nonwoven web from said fibers, wherein said mixture of fillers is incorporated into said polymer in an amount sufficient to decrease the stiffness and increase the softness of said nonwoven web in comparison to a nonwoven web made from said thermoplastic polymer not containing said fillers.

2. A process as defined in claim 1, wherein said mineral filler comprises a material selected from the group consisting of kaolin clay, calcium carbonate, talc, attapulgite clay, and mixtures thereof.

3. A process as defined in claim 1, wherein said mineral filler comprises a material selected from the group consisting of calcium carbonate, kaolin and mixtures thereof.

4. A process as defined in claim 1, wherein said titanium dioxide is added to said thermoplastic polymer in an amount from about 1% to about 2% by weight and wherein said mineral filler is added to said thermoplastic polymer in an amount from about 2.5% to about 5% by weight.

5. A process as defined in claim 1, wherein said mineral filler comprises a clay.

6. A process as defined in claim 1, wherein said thermoplastic polymer comprises polypropylene or a copolymer comprising propylene units.

7. A process as defined in claim 1, wherein said fibers are formed according to a spunbond process or a meltblown process.

8. A process as defined in claim 1, wherein said thermoplastic polymer comprises a mixture of polypropylene and a polyamide.

9. A process as defined in claim 1, wherein said mixture further comprises a wax.

10. A process as defined in claim 1, wherein the thermoplastic polymer comprises a polyolefin, a polyester, copolymers thereof or mixtures thereof.

11. A process as defined in claim 1, wherein said fibers comprise continuous meltblown fibers or continuous spunbond fibers.

12. A fiber adapted to produce webs comprising a thermoplastic polymer containing a mixture of fillers, said mixture of fillers comprising titanium dioxide and a mineral filler, the thermoplastic polymer comprising a mixture of at least a first polymer and a second polymer, the first and second polymers being selected from the group consisting of polyolefins, polyamides, polyesters, and copolymers thereof, said fillers being encapsulated within said thermoplastic polymer such that said fillers do not substantially protrude from the surface of said fiber; and wherein said titanium dioxide is present within said thermoplastic polymer in an amount from about 0.5% by weight to about 4% by weight and wherein said mineral filler is present within said thermoplastic polymer in an amount greater than zero and less than about 10% by weight.

13. A fiber as defined in claim 12, wherein said titanium dioxide is present within said thermoplastic polymer in an amount from about 1% to about 2% by weight and wherein said mineral filler is present within said thermoplastic polymer in an amount from about 2.5% to about 5% by weight.

14. A fiber as defined in claim 12, wherein said thermoplastic polymer comprises polypropylene or a copolymer comprising propylene units.

15. A fiber as defined in claim 14, wherein said titanium dioxide is present within said thermoplastic polymer in an amount from about 1% to about 2% by weight and wherein said mineral filler is present within said thermoplastic polymer in an amount from about 2.5% to about 5% by weight.

16. A fiber as defined in claim 12, wherein said mineral filler comprises a material selected from the group consisting of kaolin, calcium carbonate, and mixtures thereof.

17. A fiber as defined in claim 12, further comprising a vehicle for facilitating the addition of said fillers to said thermoplastic polymer, said vehicle comprising a wax.

18. A fiber as defined in claim 12, wherein said fiber comprises a meltblown fiber or a spunbond fiber.

19. A fiber as defined in claim 12, wherein said mixture further comprises a wax.

20. A fiber as defined in claim 12, wherein the thermoplastic polymer comprises a polyolefin, a polyester, copolymers thereof or mixtures thereof.

21. A fiber as defined in claim 12, wherein the fiber comprises a continuous meltblown fiber or a continuous spunbond fiber.

22. A nonwoven web comprising fibers made from a thermoplastic polymer, said thermoplastic polymer containing a mixture of fillers, the thermoplastic polymer comprising a mixture of at least a first polymer and a second polymer, the first and second polymers being selected from the group consisting of polyolefins, polyamides, polyesters, and copolymers thereof, said mixture of fillers comprising titanium dioxide and a mineral filler, said fillers being encapsulated within said thermoplastic polymer such that said fillers do not substantially protrude from the surface of said fibers and wherein said titanium dioxide is present within said thermoplastic polymer in an amount from about 0.5% by weight to about 4% by weight, and wherein said mineral filler is present within said thermoplastic polymer in an amount greater than zero and up to about 10% by weight.

23. A nonwoven web as defined in claim 22, wherein said mineral filler comprises a material selected from the group consisting of kaolin, calcium carbonate, and mixtures thereof.

24. A nonwoven web as defined in claim 22, wherein said thermoplastic polymer comprises polypropylene or a copolymer comprising propylene units.

25. A nonwoven web as defined in claim 22, wherein said fibers comprise meltblown fibers or spunbond fibers.

26. A nonwoven web as defined in claim 22, wherein said thermoplastic polymer comprises a mixture of polypropylene and a polyamide, said polyamide being present in said thermoplastic polymer in an amount greater than zero and up to about 5% by weight.

27. A nonwoven web as defined in claim 22, wherein said mixture further comprises a wax.

28. A non-woven web as defined in claim 22, wherein the thermoplastic polymer comprises a polyolefin, a polyester, copolymers thereof or mixtures thereof.

29. A non-woven web as defined in claim 22, wherein the fibers comprise continuous meltblown fibers or continuous spunbond fibers.

30. A nonwoven web comprising fibers made from an extruded polymer, said polymer comprising a thermoplastic polymer containing a mixture of fillers, the thermoplastic polymer comprising a mixture of at least a first polymer and a second polymer, the first and second polymers being selected from the group consisting of polyolefins, polyamides, polyesters, and copolymers thereof, said mixture of fillers comprising titanium dioxide present in an amount from about 0.5% by weight to about 4% by weight and a mineral filler present in an amount from about 0.1% by weight to about 10% by weight, said fillers being encapsulated within said thermoplastic polymer.

31. A nonwoven web as defined in claim 30, wherein said thermoplastic polymer comprises polypropylene or a copolymer comprising propylene units.

32. A nonwoven web as defined in claim 30, wherein said titanium dioxide is present within said thermoplastic polymer in an amount from about 1% to about 2% by weight, and wherein said mineral filler is present within said thermoplastic polymer in an amount from about 2.5% to about 5% by weight.

33. A nonwoven web as defined in claim 32, wherein said mineral filler comprises kaolin.

34. A nonwoven web as defined in claim 32, wherein said mineral filler comprises calcium carbonate.

35. A nonwoven web as defined in claim 30, wherein said extruded fibers comprise meltblown fibers or spunbond fibers.

36. A nonwoven web as defined in claim 30, wherein said thermoplastic polymer comprises a mixture of polypropylene and a polyamide, said polyamide being present in said thermoplastic polymer in an amount greater than zero and up to about 5% by weight.

37. A nonwoven web as defined in claim 30, wherein said mixture further comprises a wax.

38. A non-woven web as defined in claim 30, wherein the thermoplastic polymer comprises a polyolefin, a polyester, copolymers thereof or mixtures thereof.

39. A non-woven web as defined in claim 30, wherein the fibers comprise continuous spunbond fibers or continuous meltblown fibers.

40. A nonwoven web comprising fibers made from an extruded polymer, said polymer comprising a mixture of polypropylene and a polyamide, said polymer containing a mixture of fillers, said mixture of fillers comprising titanium dioxide present in an amount greater than zero and up to about 4% by weight and a mineral filler present in an amount greater than zero and up to about 10% by weight, said fillers being encapsulated within said polymer.

41. A nonwoven web as described in claim 40, wherein said polymer comprises up to about 5% by weight of said polyamide.

42. A nonwoven web as defined in claim 40, wherein said mineral filler comprises kaolin.

43. A nonwoven web as defined in claim 40, wherein said mineral filler comprises calcium carbonate.

44. A nonwoven web as defined in claim 40, wherein said mixture further contains a wax.

45. A process for improving the thermal aging stability of a nonwoven web made from polymeric fibers, said process comprising the steps of:

incorporating into a thermoplastic polymer a mixture of fillers, the thermoplastic polymer comprising a mixture of at least a first polymer and a second polymer, the first and second polymers being selected from the group consisting of polyolefins, polyamides, polyesters, and copolymers thereof, said mixture of fillers comprising titanium dioxide and a mineral filler, said titanium dioxide being present in said polymer in an amount from about 0.5% by weight to about 4% by weight and said mineral filler being present in said polymer in an amount greater than zero and up to about 10% by weight;

forming said thermoplastic polymer into fibers, said titanium dioxide and said mineral filler being encapsulated in said fibers; and creating a nonwoven web from said fibers, wherein said mixture of fillers is incorporated into said polymer in an amount sufficient to increase the thermal aging stability of said nonwoven web.

46. A process as defined in claim 45, wherein said mineral filler comprises a material selected from group consisting of kaolin clay, calcium carbonate, and mixtures thereof.

47. A process as defined in claim 45, wherein the thermoplastic polymer comprises a polyolefin, a polyester, copolymers thereof or mixtures thereof.

48. A process as defined in claim 45, wherein the fibers comprise continuous meltblown fibers or continuous spunbond fibers.

* * * * *